US005615881A

United States Patent [19]

Potter

[11] Patent Number: 5,615,881

[45] Date of Patent: Apr. 1, 1997

[54] CHILDREN'S FISHING GAME

[76] Inventor: Denise P. Potter, 39 Creek View Rd., Coto de Caza, Calif. 92679

[21] Appl. No.: 557,964

[22] Filed: Nov. 13, 1995

[51] Int. Cl.[6] ..... A63F 9/00

[52] U.S. Cl. ..... 273/140

[58] Field of Search ..... 273/140; 446/486

[56] References Cited

U.S. PATENT DOCUMENTS

| | | | |
|---|---|---|---|
| D. 333,502 | 2/1993 | Onishi | D22/142 |
| D. 337,629 | 7/1993 | Lal | D21/157 |
| 346,892 | 8/1886 | Bullock | 273/140 |
| 2,509,785 | 5/1950 | Rubin | 273/140 X |
| 2,598,487 | 5/1952 | Anechiarico | 273/140 X |

*Primary Examiner*—William H. Grieb
*Attorney, Agent, or Firm*—James G. O'Neill

[57] ABSTRACT

A child's fishing game for use on the ground or in water, having an elongated, substantially large diameter, flexible, lightweight fishing pole with two ends, one of which has a catching means secured thereto for use in capturing one or more substantially flat fish shaped members having at least one loop means secured thereto, and through which the catching means may be inserted when the pole is manipulated by a child.

19 Claims, 1 Drawing Sheet

10
26'
30
32

16
10
12
14
20
22
18

10
26
24
28
22

CHILDREN'S FISHING GAME

BACKGROUND OF THE INVENTION

1. Field of the Invention

This invention relates generally to children's games, and, more particularly, to an improved children's fishing game which further aids in the development of eye-hand coordination and manual dexterity.

2. Description of Related Art

There are many known prior art fishing games, toy fish and/or rods used by children to simulate fishing, or some aspect thereof. Additionally, numerous types of fresh water and salt water fishing poles or rods are known, as well as various toy fishing rods having reels and magnetic catching means, for the amusement of children. One such fishing rod is disclosed in U.S. Pat. No. 3,864,872 to Hoetzel, which shows a simulated rod and reel having at least one reel, a line and a magnet at the end of the line for picking up metallic "fish", or other objects having at least a portion thereof which is metallic. Other typical prior art devices, games, toy fish and fishing rods are set forth in the following listed U.S. Pat. Nos.:

| | |
|---|---|
| 4,165,075 to Popovich | 4,936,574 to Lee |
| 4.229,003 to Shimizu | 5,340,120 to Holyoak |
| 4,272,075 to Rodgers, Jr. | 5,141,465 to Stellman |
| 4,272,913 to Bisch | 5,207,424 to Bleam et al. |
| 4,650,192 to Todokoro | Des. 325,421 to Yasui |
| Des. 333,502 to Onishi | Des. 337,629 to Lal |

Although these prior art devices and games provide children with enjoyment, and some aid in eye-hand coordination, they do not meet today's stringent safety codes or the needs of all children, nor are they useful in substantially all situations by most children, such as toddlers. Therefore, there still exists the need in the art for a simple to use fishing game and or rod, which may be safely used by substantially any child, after becoming a toddler. Additionally, such a game should also be capable of being used in a back yard, a park, or in substantially any size body of water, such as a home swimming pool, or the like.

SUMMARY OF THE INVENTION

Accordingly, it is a general object of the present invention to provide an improved fishing game. It is a particular object of the present invention to provide an improved fishing game utilizing an enlarged, lightweight pole and floatable toy fish. It is a still more particular object of the present invention to provide an improved fishing game utilizing toy fish having at least one loop formed thereon. It is yet a more particular object of the present invention to provide an improved fishing game utilizing an enlarged, lightweight pole and floatable fish, in which the pole has a resilient catching means mounted on one end for maneuvering and catching toy fish floating on the surface of a body of water. It is a further object of the present invention to provide an improved fishing game utilizing toy fish having at least one loop formed thereon and which loops are capable of being captured or "hooked" by a resilient catching mounted to an end of an elongated, enlarged diameter, flexible, lightweight fishing pole. And, it is yet a further object of the present invention to provide an improved game utilizing an elongated, enlarged diameter, flexible, lightweight fishing pole and substantially flat toy fish having loop means which may be placed on substantially any surface and captured or "hooked" by resilient a capturing means, removably secured to one end of the elongated, enlarged diameter, lightweight fishing pole.

In accordance with one aspect of the present invention, there is provided an elongated, substantially large diameter, lightweight fishing pole having two ends. A catching means is secured at one end of the fishing pole for use to capture a one or more substantially flat toy fish-shaped members having at least one loop means secured thereto, and through which the catching means may be inserted by manipulation of the fishing pole by a child.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figures 1, 2, 3, 4:
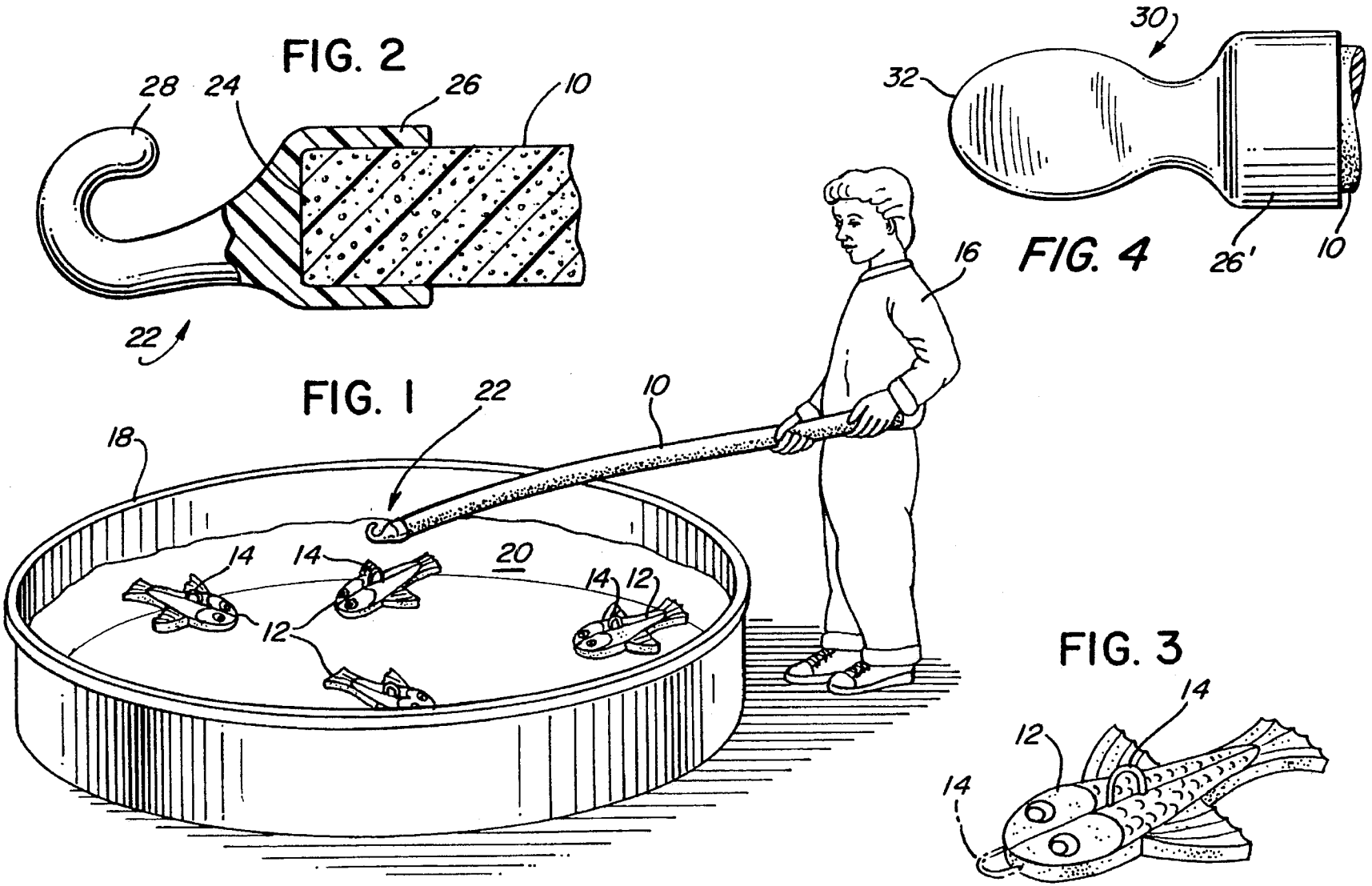
FIG. 1 is a perspective view of a child standing adjacent a pool having water therein with a plurality of fish with loops of the present invention floating on the surface of the water and a child holding an elongated, enlarged diameter, flexible, lightweight fishing pole of the present invention, including a resilient capturing means on the outer end thereof, in a position to capture or "hook" one or more of the floating fish.
FIG. 2 is a enlarged, partial sectional view of the end of the fishing pole of FIG. 1, showing the capturing means as an end cap having a flexible hook secured to one end of the pole.
FIG. 3 is a further perspective view of a preferred embodiment of one of the toy fish of the present invention, having one or more loop means formed thereon.
FIG. 4 is an enlarged end view of a further embodiment of an end cap having a spoon shaped resilient hooking or capturing means secured to one end of the pole.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved children's fishing game utilizing an elongated, preferably flexible, enlarged diameter, lightweight fishing pole 10 and substantially flat toy fish 12, having at least one loop means 14 secured thereto.

Although it is to be understood that the toy fish 12 may be of any desired shape, and be made from any nontoxic material suitable for use by children on the ground or in water, the toy fish 12 are preferably made from a lightweight plastic material which will float on the surface of a body of water, such as when placed in a pool, or the like, as shown in FIG. 1. For illustrative purposes only, and not by way of limitation, the fishing pole 10 of the present invention is shown being used by a child 16, standing adjacent to a wading pool 18, having water therein, and a plurality of toy fish 12 floating on the surface 20 of the water.

The fishing pole 10 is preferably made from a lightweight foamed plastic material, in any known manner, such as by extrusion, and has a substantially large external diameter, preferably from about 2 inches to 3 inches, so as to be easily handled and manipulated by any toddler, or older child. Additionally, depending on the age of the child using the pole, and the size of the body of water, or ground area over which the toy fish 12 are scattered, the pole 10 may be of any desired length, preferably from between about 3 feet to about 8 feet long.

The pole 10 also includes a capturing, catching or hooking means 22, secured to one end of the pole. This catching means 22 may take any desired shape so long as it is sized and dimensioned so that the pole may be manipulated by a child to insert the catching means into one of the loops 14 of a toy fish 12 sitting on the surface of the ground or floating on the surface of a body of water, to catch, capture or hook the toy fish, by loop means therein. The catching means may cause the pole to flex.

Turning now to FIG. 3, there shown is a preferred embodiment of the toy fish 12, having the loop means 14 secured to the top surface thereof. However, alternatively, or in addition to the top loop 14, a loop may be secured at the front or other end of the toy fish, such as that shown in broken line at 14'. Either or both of the loops 14, 14', may be formed integrally with or secured to the toy fish 12, as by an adhesive, and are preferably sized and dimensioned so that they may be caught or "hooked" by the catching means 22 at the end of the fishing pole 10, when being manipulated by a toddler, child, or other person. Of course, depending on the age and the skill level of the person using the pole 10, the game may be made easier or harder. For example, the loops 14, 14' on the toy fish 10 may be made larger (easier to hook) or the loops may be made smaller (harder to hook). And/or, the catching means may be changed so as to be smaller or larger, or more or less resilient.

The catching means 22 is preferably removably secured on a first end 24 of the pole 10, as by a cup shaped portion 26 slid onto the first end, with sufficient friction therebetween to remain on the pole in use by a child, but capable of being slid off when rotated or pulled on by an adult. Although it is to be understood that in some circumstances it might be best to permanently secure the cup shaped portion to the first end 24, as by means of an adhesive. A resilient hook shaped capturing or hooking end 28 extends from and is integrally formed with or secured to the cup shaped portion 26, in any known manner. Or, as shown in FIG. 4, a catching means 30 having a cup shaped portion 26' and a spoon shaped capturing or hooking end 32 may be used. Both the hook shaped means 28 and spoon shaped capturing means 32 should be formed from a flexible resilient material, such as rubber or plastic for safety reasons. Again, either of the catching means 22 or 30 should be sized and dimensioned so that the fishing pole 10 may be easily manipulated by a toddler or child when attempting to insert the catching means 22, 30 into one of the loops 14, 14' of a toy fish 12, to catch, capture or hook the toy fish.

When playing a game with the pole 10 and fish 12 of the present invention, the toy fish may have letters, numbers or symbols attached thereto or printed thereon, and the persons playing the game therewith awarded points or prizes for catching specific toy fish in a particular order; i.e., to spell out words, add up to a specific number, or form some desired picture or symbol.

It, therefore, can be seen that the elongated, enlarged diameter pole 10, having a catching means secured at one end thereof, enables a child to maneuver the same to catch or capture toy fish via loop means formed on the toy fish of the present invention. This combination of the flexible pole and the fish provide additional enjoyment and challenge for a toddler or child, whether around water or on a flat surface, such as the ground, for both the amusement of the child and to help train the child in eye-hand coordination and manual dexterity.

It, thus, can be seen that the fishing pole and floatable fish of the present invention provide an improved fishing game for enhanced enjoyment and fun, unattainable with known fishing games.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed:

1. A fishing game for playing in water, comprising:

an elongated, large diameter, lightweight fishing pole having a first end and a second end with a catching means secured to said first end; said fishing pole being flexible and made from a foamed plastic;

a body of water having a surface;

a plurality of substantially flat, fish shaped members made from a lightweight material floating on the surface of the body of water; each of the fish shaped members having a loop means secured thereto;

said catching means including a holding portion secured to said first end, and a resilient catching portion secured to said holding portion; and said loop means being sized and dimensioned so as to allow a child manipulating said elongated, enlarged diameter lightweight fishing pole by said second end to insert said resilient catching portion into a loop means of one of said plurality of substantially flat fish shaped members.

2. The fishing game of claim 1 wherein said resilient catching means is hook shaped.

3. The fishing game of claim 1 wherein said elongated, enlarged diameter, lightweight fishing pole is between 2" and 3" in diameter.

4. The fishing game of claim 3 wherein said elongated, enlarged diameter, lightweight pole is between 3' and 8' long.

5. A fishing game for playing in water, comprising:

an elongated, enlarged large diameter, lightweight fishing pole having a first end and a second end with a catching means secured to said first end;

a body of water having a surface;

a plurality of substantially flat, fish shaped members made from a lightweight material floating on the surface of the body of water; each of the fish shaped members having a loop means secured thereto;

said catching means including a holding portion secured to said first end, and a resilient spoon-shaped catching portion secured to said holding portion; and said loop means being sized and dimensioned so as to allow a child manipulating said elongated, enlarged diameter lightweight fishing pole by said second end to insert said resilient catching portion into a loop means of one of said plurality of substantially flat fish shaped members.

6. The fishing game of claim 5 wherein said elongated, enlarged diameter, lightweight fishing pole is flexible and made from a foamed plastic.

7. The fishing game of claim 6 wherein said elongated, enlarged diameter, lightweight fishing pole is between 2" and 3" in diameter.

8. The fishing game of claim 7 wherein said elongated, enlarged diameter, lightweight pole is between 3' and 8' long.

9. A game, comprising:

an elongated, substantially large diameter, lightweight, flexible pole having a first end and a second end with a catching means secured to said first end;

a plurality of substantially flat, fish shaped members made from a lightweight material;

said catching means including an enlarged cap secured over said first end of said elongated, substantially large diameter, lightweight, flexible pole, and a resilient catching means secured to said enlarged cap; and each of said plurality of substantially flat, fish shaped members having at least one loop means secured thereto; each of said at least one loop means being sized and dimensioned so as to allow a child manipulating said elongated, substantially large diameter, lightweight, flexible pole by said second end to insert said resilient catching means into a loop means of one of said plurality of substantially flat fish shaped members.

10. The fishing game of claim 9 wherein said resilient catching means is hook shaped.

11. The fishing game of claim 10 wherein said elongated, substantially large diameter, lightweight pole is flexible and made from a foamed plastic.

12. The fishing game of claim 11 wherein said elongated, substantially large diameter, lightweight pole is between 2" and 3" in diameter.

13. The fishing game of claim 12 wherein said elongated, substantially large diameter, lightweight pole is between 3' and 8' long.

14. The fishing game of claim 9 wherein said resilient catching means is spoon shaped.

15. The fishing game of claim 14 wherein said elongated, enlarged diameter, lightweight fishing pole is flexible and made from a foamed plastic.

16. The fishing game of claim 15 wherein said elongated, enlarged diameter, lightweight fishing pole is between 2" and 3" in diameter.

17. The fishing game of claim 16 wherein said elongated, enlarged diameter, lightweight pole is between 3' and 8' long.

18. A child's fishing game, comprising:

a fishing pole between 2" and 3" in diameter and 3' and 8 ' long made from an extruded foamed plastic; said fishing pole being flexible and having a first end and a second end;

a resilient catching means made from the group consisting of rubber and nontoxic plastics secured to said first end; said catching means including an enlarged cap portion secured over said first end, and a resilient catching portion secured to said enlarged cap portion; and a plurality of substantially flat, floatable toy fish made from a lightweight plastic material; each of said plurality of substantially flat, fish shaped members having a top surface and a bottom surface with a loop secured to said top surface; each of the loop being sized and dimensioned so as to allow a child manipulating said fishing pole by said second end to insert said resilient catching portion into a loop of one of said plurality of toy fish.

19. A child's fishing game for playing in water, comprising:

a body of water having a surface;

a flexible fishing pole between 2" and 3" in diameter and 3' and 8' long made from an extruded foamed plastic; said fishing pole having a first end and a second end;

a resilient catching means made from the group consisting of rubber and nontoxic plastics secured to said first end; said catching means including an enlarged cap portion secured over said first end, and a resilient catching portion secured to said enlarged cap portion; and a plurality of substantially flat, floatable toy fish made from a lightweight plastic material floating on said surface of said body of water; each of said plurality of substantially flat, fish shaped members having a top surface and a bottom surface; each of the bottom surfaces floating on said surface of said body of water, and a loop secured to each of the top surfaces; each of the loops being sized and dimensioned so as to allow a child manipulating said fishing pole by said second end to insert said resilient catching portion into a loop of one of said plurality of toy fish while floating on the surface of said body of water.

* * * * *